US006030324A

United States Patent [19]

McBride

[11] Patent Number: 6,030,324

[45] Date of Patent: Feb. 29, 2000

[54] MULTI-PURPOSE EXERCISE BENCH

[75] Inventor: Robert W. McBride, Springfield, Mo.

[73] Assignee: Stamina Products, Inc., Springfield, Mo.

[21] Appl. No.: 09/017,321

[22] Filed: Feb. 3, 1998

[51] Int. Cl.[7] ..... A63B 26/00

[52] U.S. Cl. ..... 482/142

[58] Field of Search ..... 482/23, 123, 130, 482/138, 142; 5/633, 634; 297/377; D21/690

[56] References Cited

U.S. PATENT DOCUMENTS

| | | |
|---|---|---|
| 225,352 | 3/1880 | De Mott . |
| D. 277,219 | 1/1985 | Johnson . |
| D. 295,809 | 5/1988 | Green . |

(List continued on next page.)

FOREIGN PATENT DOCUMENTS

| | | |
|---|---|---|
| 966 523 | 4/1975 | Canada . |
| 1 256 137 | 6/1989 | Canada . |
| 1 289 156 | 9/1991 | Canada . |
| 2639307 A1 | 3/1978 | Germany . |
| 3417719 A1 | 11/1985 | Germany . |

*Primary Examiner*—Richard J. Apley
*Assistant Examiner*—Denise Pothier
*Attorney, Agent, or Firm*—Pillsbury Madison & Sutro Intellectual Property Group

[57] ABSTRACT

A multi-position exercise bench includes an elongated central frame member to which a back support having a head end and a seat end is attached and to which a seat structure is attached near the seat end of the back support structure. The seat structure is pivotal between an upright position extending transversely from the central frame member and a lowered position in which a top surface of the seat structure is at an obtuse angle with respect to a top surface of the back support structure and is selectively securable in a plurality of different positions. The central frame member is supported by a first leg attached at one end of the frame member, a second leg extending transversely from an intermediate portion of the central frame member opposite the seat structure, and a third leg pivotally attached to an end of the central frame member opposite the first leg. The bench can be configured as an inclined bench supported on the first and second legs, a flat bench supported on the second leg and the third leg locked in a transverse position extending transversely from the central frame member, and a slant bench supported on the second leg and the third leg extending longitudinally away from the central frame member. The first leg also functions as a foot holder in which an exerciser can engage his feet to hold them stationary while performing exercises on the bench when the bench is in a slant board configuration. The bench also includes a dumbbell rack operatively secured onto the second leg for conveniently storing a plurality of dumbbells which can be used while performing exercises on the bench in each of the various configurations.

9 Claims, 6 Drawing Sheets

U.S. PATENT DOCUMENTS

| | | | |
|---|---|---|---|
| D. 329,563 | 9/1992 | Rasmussen . | |
| 336,156 | 2/1886 | Pursell, Sr. . | |
| D. 339,617 | 9/1993 | Harashima . | |
| 353,459 | 11/1886 | Newcomb . | |
| D. 362,776 | 10/1995 | Thorn . | |
| D. 366,917 | 2/1996 | Clem . | |
| D. 406,290 | 3/1999 | McBride | D21/690 |
| 911,319 | 2/1909 | Montague | 297/354.13 |
| 2,850,081 | 9/1958 | Dillon . | |
| 2,929,375 | 3/1960 | Spinks . | |
| 3,114,545 | 12/1963 | Horn . | |
| 3,136,269 | 6/1964 | McDonald . | |
| 3,601,397 | 8/1971 | Carlin . | |
| 3,653,715 | 4/1972 | Drabert . | |
| 3,682,475 | 8/1972 | Walker . | |
| 3,814,416 | 6/1974 | Munger . | |
| 3,857,561 | 12/1974 | Cecchettini . | |
| 3,866,605 | 2/1975 | Stakeman . | |
| 4,067,326 | 1/1978 | Lay . | |
| 4,072,309 | 2/1978 | Wilson . | |
| 4,197,839 | 4/1980 | Lay . | |
| 4,249,726 | 2/1981 | Faust . | |
| 4,358,109 | 11/1982 | Schrems . | |
| 4,369,966 | 1/1983 | Silberman . | |
| 4,477,074 | 10/1984 | Bushnell . | |
| 4,575,077 | 3/1986 | Osborne . | |
| 4,597,553 | 7/1986 | Rorabaugh . | |
| 4,609,192 | 9/1986 | Bratcher | 482/142 |
| 4,615,524 | 10/1986 | Sutherland . | |
| 4,746,114 | 5/1988 | Grider | 482/104 |
| 4,749,190 | 6/1988 | Jennings . | |
| 4,759,539 | 7/1988 | Nieppola . | |
| 4,773,642 | 9/1988 | Cruz . | |
| 4,871,166 | 10/1989 | Sterba et al. | 482/142 |
| 4,884,804 | 12/1989 | Fenwick . | |
| 4,927,135 | 5/1990 | Nieppola . | |
| 5,082,260 | 1/1992 | Dinelli . | |
| 5,125,884 | 6/1992 | Weber . | |
| 5,176,603 | 1/1993 | Hundley . | |
| 5,190,513 | 3/1993 | Habing . | |
| 5,232,426 | 8/1993 | Van Straaten . | |
| 5,272,825 | 12/1993 | Simpson . | |
| 5,300,005 | 4/1994 | Wang | 482/142 |
| 5,320,592 | 6/1994 | Olschansky . | |
| 5,411,459 | 5/1995 | Hayden . | |
| 5,429,570 | 7/1995 | Beyer . | |
| 5,472,397 | 12/1995 | Ammoscato . | |
| 5,616,108 | 4/1997 | Hayden . | |
| 5,637,059 | 6/1997 | Dalebout . | |
| 5,882,283 | 3/1999 | Stevens . | |

MULTI-PURPOSE EXERCISE BENCH

BACKGROUND OF THE INVENTION

The present invention relates to an exercise bench which may be easily arranged in each of an inclined bench, a flat bench, and a slant board configuration to permit an exerciser to perform a variety of exercises thereon in each of the different configurations.

Benches of various sizes and configurations are used by exercisers to assist in the performance of a variety of exercises. Different bench configurations permit an exerciser to perform different exercises thereon to exercise and isolate different sets of muscles.

For example, an inclined bench includes a seat and a backrest extending up from the seat inclined with respect to the floor so that the upper portion of the backrest is above the lower portion of the backrest. An exerciser may sit on the seat and recline in an at least partially upright position against the inclined backrest and can perform a variety of upper body exercises on the bench with weight or resistance training devices, such as dumbbells. The exercises which can be performed include chest press, lateral butterfly, and arm curl, each of which isolates and exercises a particular set of upper body muscles.

A flat bench provides a generally horizontal backrest upon which an exerciser may lie in a supine position. Again, the exerciser can perform chest presses and lateral butterflies, isolating a different set of upper body muscles then when the same exercises are performed on an incline bench. In addition, the exerciser can sit upright on the flat bench and perform a shoulder press exercise.

A slant board presents a declined backrest, i.e., a head portion of the backrest is disposed below a seat portion of the backrest. A slant board typically also includes foot holding structures. An exerciser can lie upon the slant board with his upper body disposed below his lower body and can perform chest presses, lateral butterflies, and a variety of abdominal exercises such as sit-ups and crunches. The exerciser can hold his feet stationary by engaging his feet with the foot holding structures. The user can also reverse positions on the slant board, so that the upper body is above the lower body, and perform inclined leg lift abdominal exercises.

To take advantage of the variety of exercises which may be performed on the various bench configurations described above, one would conventionally need multiple benches of different configurations. The need for multiple benches can present space problems, especially for the home user, and also leads to the added expense of purchasing multiple different benches.

SUMMARY

The present invention addresses the disadvantages described above in a single multi-purpose exercise bench. The invention provides a multi-position exercise bench on which a user can perform a variety of exercises with the bench oriented in each of a plurality of different exercise configurations. The bench comprises a longitudinal frame structure having a back support structure attached thereto and a seat structure extending transversely with respect to the longitudinal frame structure from a position on the longitudinal frame structure near a seat end of the back support structure. A plurality of support legs are connected to the longitudinal frame structure for supporting the longitudinal frame structure on the floor in each of a plurality of exercise configurations. Specifically, the plurality of support legs are constructed and arranged with respect to each other and the longitudinal frame structure to permit the multi-position exercise bench to be configured as either: (1) an inclined bench with the back support structure oriented at an angle with respect to the floor with a head end of the back support structure disposed above the seat end thereof, (2) a flat bench with the back support structure oriented generally parallel with respect to the floor with the head end of the back support structure disposed at generally the same elevation as the seat end of the back support structure, and (3) a slant bench with the back support structure oriented at an angle with respect to the floor with the head end of the back support structure disposed below the seat end of the back support structure. The legs are arranged so that the bench can be reoriented merely by tipping the bench into one of the desired configurations. No reconfiguring of the back support structure is necessary, and relatively little reconfiguring of the legs is necessary. The bench may also include a foot engaging member with which a user can engage his feet while lying upon the back support structure, while the bench is configured as a slant bench, with the user's legs bent over an end of the seat structure to hold the user's feet stationary while performing exercises, and the bench may also include a dumbbell storage rack conveniently attached to the bench.

Other objects, features, and characteristics of the present invention will become apparent upon consideration of the following description and the appended claims with reference to the accompanying drawings, all of which form a part of the specification, and wherein like reference numerals designate corresponding parts in the various figures.

DETAILED DESCRIPTION OF THE INVENTION

There is shown in FIG. a multi-purpose exercise bench, generally indicated at 10, having the versatility to be easily configured in a variety of positions, including the inclined bench slant board and flat bench positions in accordance with the principles of the present invention. The multi-purpose exercise bench 10 of the present invention is designed to enable the user to develop a plurality of muscle groups using only a single apparatus, in easily converted positions, for maximizing the effectiveness of the exercises performed. The exercise bench 10 comprises a frame structure assembly, generally indicated at 12, an adjustable seat assembly, generally indicated at 14, and a seat rest and backrest shown at 16 and 18, respectively. Additionally, there is an attached dumbbell storage bracket, generally indicated at 20.

Figure 1:
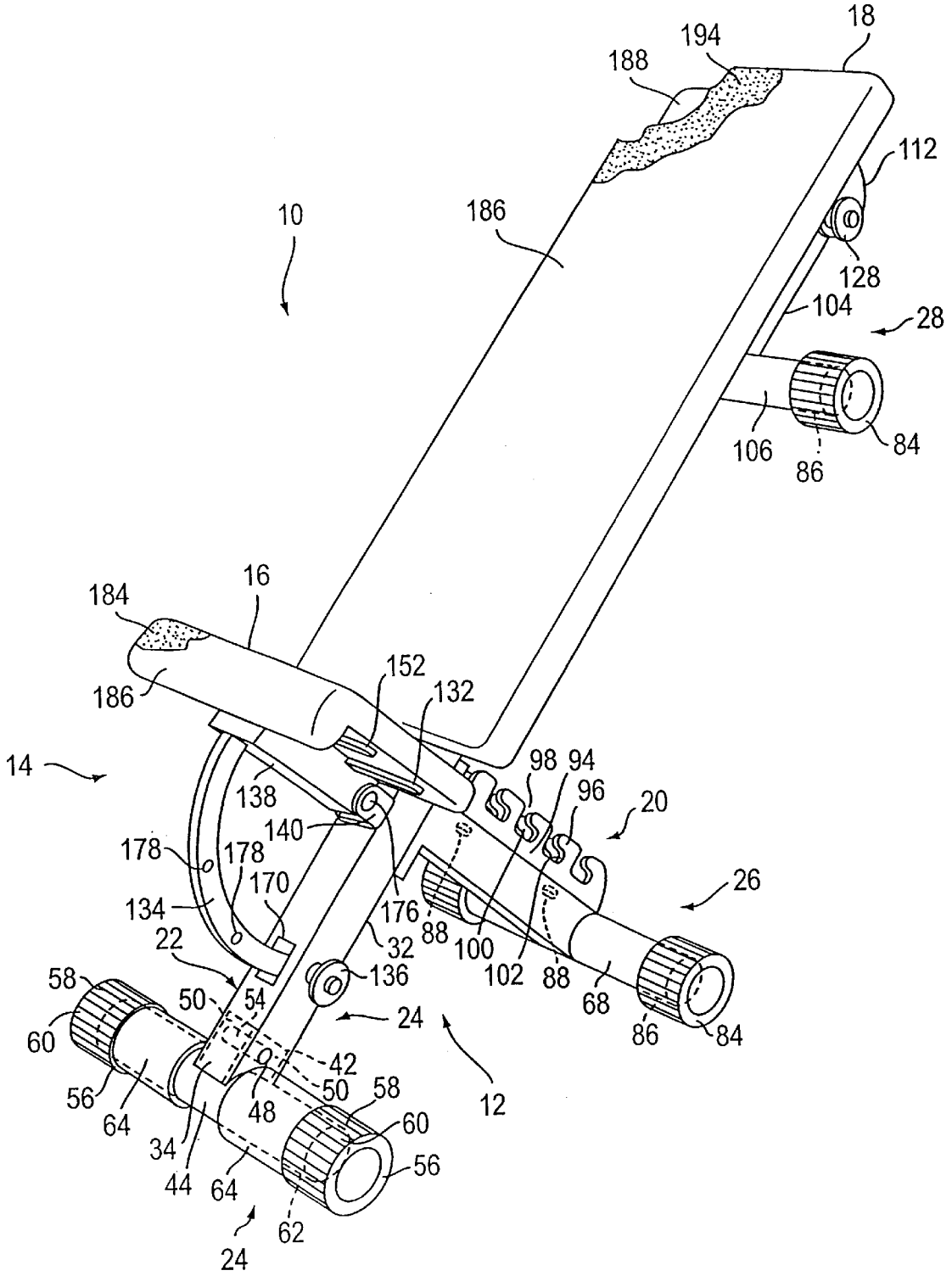
FIG. 1 is a perspective view of a multi-purpose exercise bench in an inclined position in accordance with the present invention.
Figure 2:
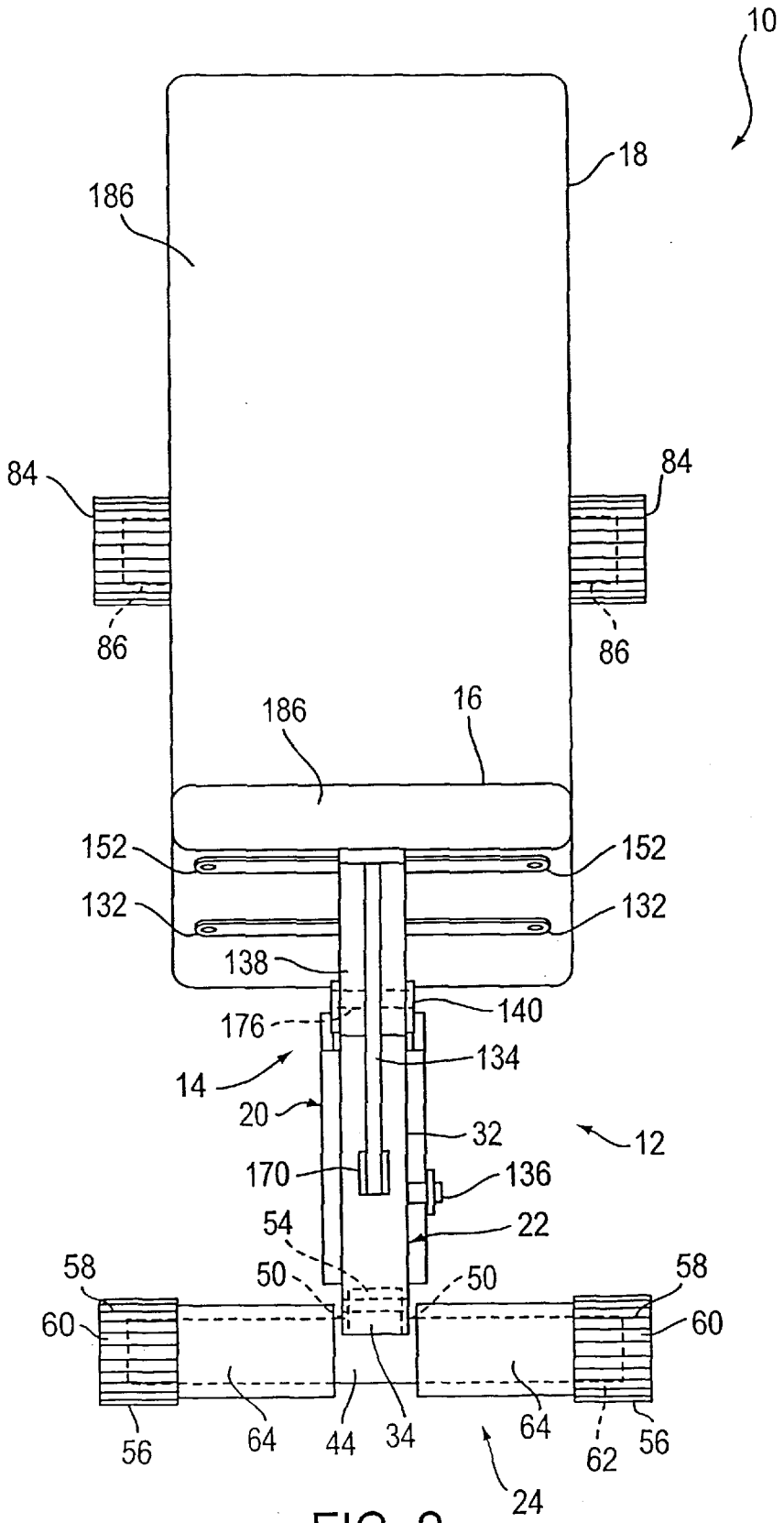
FIG. 2 is a front end elevation of the multi-purpose exercise bench.
Figure 4:
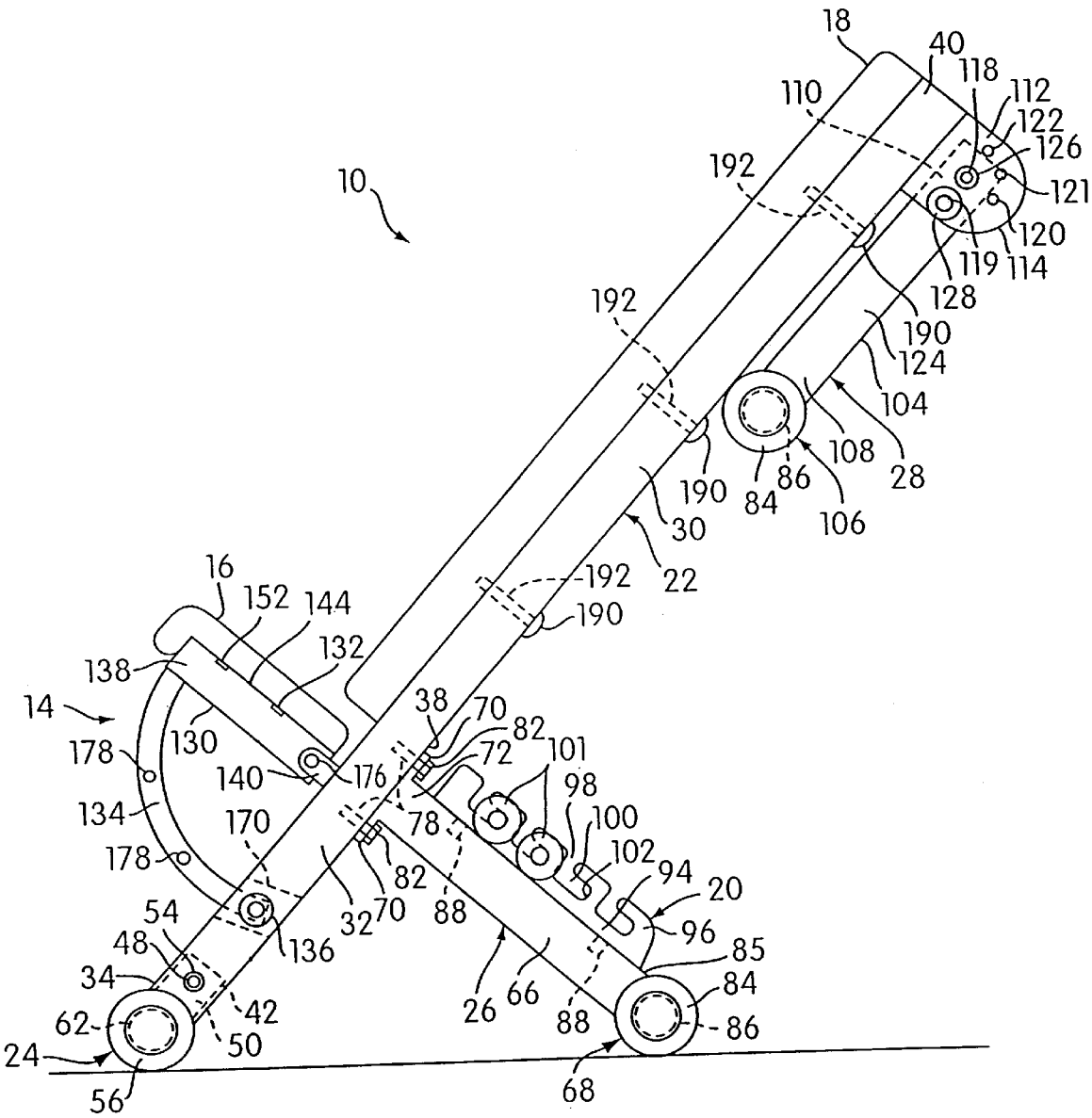
FIG. 4 is a side elevation of the exercise bench arranged in an inclined bench configuration.

As shown in FIGS. 1 and 4, the frame structure assembly 12 of the multi-purpose exercise bench 10 consists of longitudinal frame structure which preferably comprises an elongated central frame member 22 and attached support leg members, indicated at 24, 26, 28. More specifically, the central frame member 22 comprises an upper backrest portion 30 and a lower portion 32. The frame member 22 is supported by the first leg member 24 extending transversely with respect to the bottom end 34 of the lower portion 32, the second leg member 26 attached to the underside 38 of the central member 22 proximate the lower portion 32 and extending transversely therefrom, and the third, pivoting leg member 28 attached along the underside 38 of the central frame member 22 at the top end 40 of the upper backrest portion 30. The second leg member 26 is a stationary support about which the exercise bench 10 pivots in order to change bench configurations. The pivoting leg member 28 is manually adjustable in order to properly place the exercise bench 10 into various positional configurations, as will be explained herein.

As shown in FIG. 1, the short leg member 24 has a short, rectangularly-shaped tubular section 42 mounted centrally to a transverse, cylindrical foot element 44. The tubular section 42 is preferably welded to the elongated foot element 44 and is sized to telescopically fit into the open bottom end 34 of the lower portion 32 of the central frame member 22. Apertures 48 in both side portions 50 of the tubular section 42 are axially aligned with apertures in the lower seat portion 32 of the central frame member 22, and leg member 24 is attached to central frame member 22 by bolt 54 extending through apertures 48.

Cylindrical foot element 44 is preferably attached to the bottom end 34 of the central frame member 22 by other means, such as welding or brazing foot element 44 directly to bottom end 34.

Molded rubber or plastic end caps 56, preferably having longitudinal, circumferentially-spaced ribs 58 along an outer surface 60 thereupon, preferably cover the open ends 62 of the foot element 44 providing slip-free traction on the floor as shown. An alternative cap-style, not shown, may be used in which a portion of the end of the end cap peripheral wall upon which the bench 10 is supported, is flat, as opposed to being arcuate, thereby adding an additional element of stability to the bench 10, particularly while in an inclined position. Cylindrical foam rolls 64 may be placed over the elongated foot element 44 on either side of the central frame member 22, providing padding for the feet and instep area of the user while exercising, as will be described below.

Figure 5:
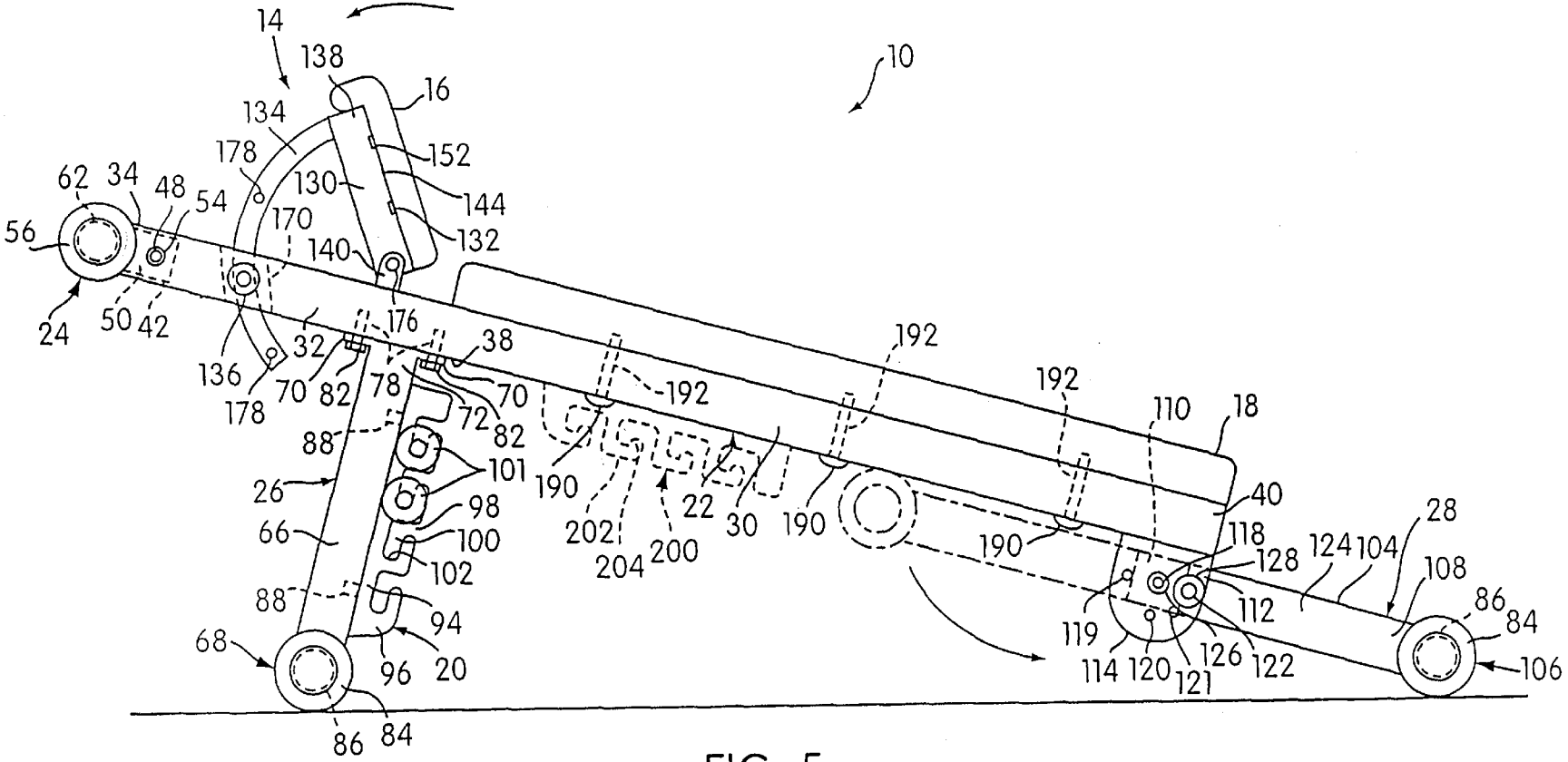
FIG. 5 is a side elevation of the exercise bench arranged in a slant board configuration.
Figure 6:
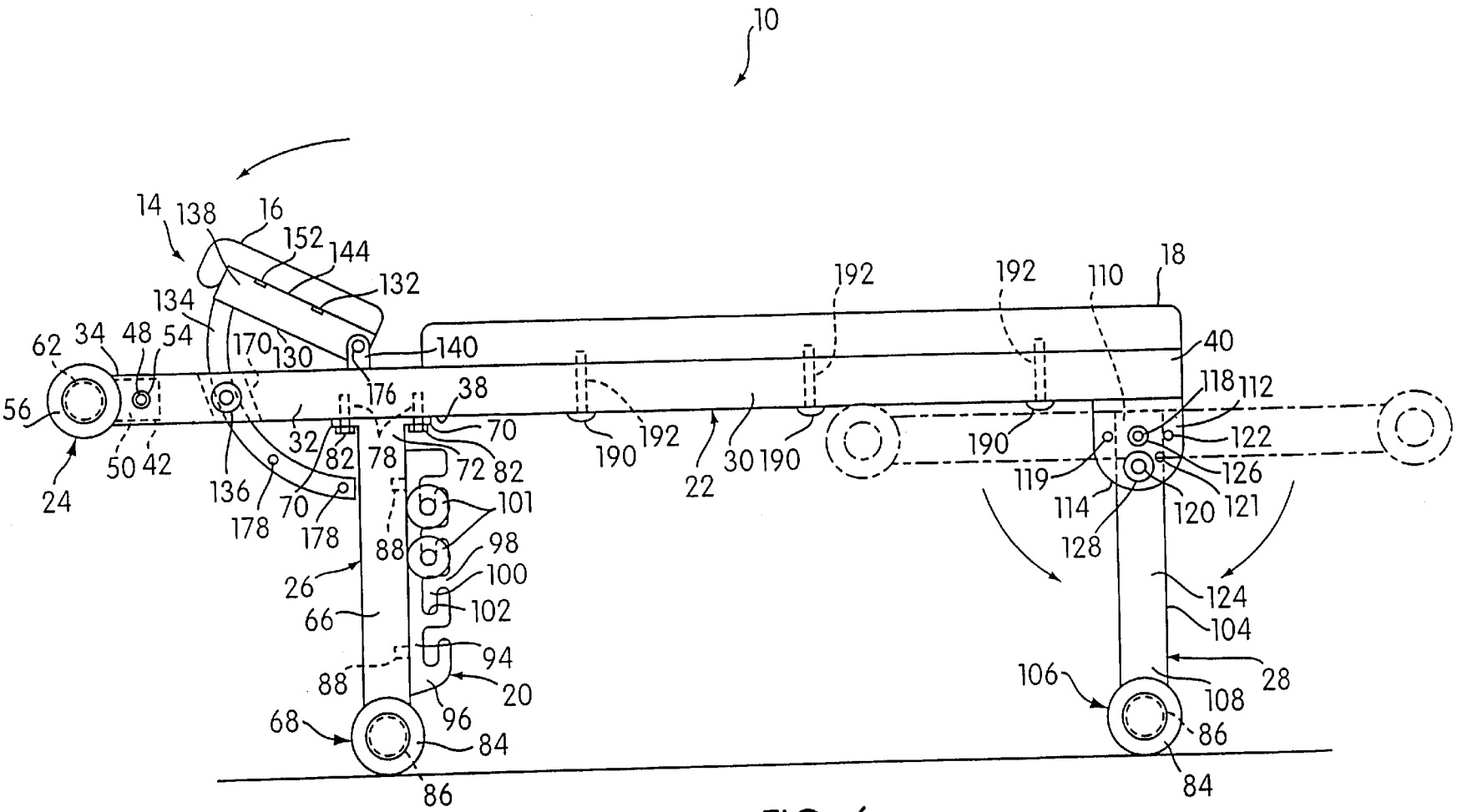
FIG. 6 is a side elevation of the exercise bench arranged in a flat bench configuration.

As shown in FIGS. 1 and 4, the second leg member 26, includes a tubular leg section 66 having a transversely mounted, cylindrical foot element 68 at the bottom end thereof and a pair of laterally extending attaching flanges 70 at the top end 72 thereof (see FIGS. 5 and 6). The tubular leg section 66 is centrally welded to the foot element 68 and extends from a midpoint of the foot element 68 to the underside 38 of the lower portion 32 of the central frame member 22. Foot element 68 is preferably of substantially the same length and diameter as the cylindrical foot element 44 attached to the short leg member 24 and also preferably has molded rubber or plastic end caps 84 covering open ends 86 of the foot element 68. The tubular section 66 is substantially equal in size cross-sectionally to the central frame member 22.

Apertures located centrally on the attaching flanges 70, are aligned with a set of apertures 78 (see FIG. 4) formed centrally in the underside 38 of the lower portion 32 of the central frame member 22. The attaching flanges 70 are bolted through the apertures 78 into the underside 38 of the lower portion 32 by bolts 82, thereby perpendicularly attaching the tubular leg section 66 to the central frame member 22. Alternatively, tubular leg section 66 can be attached directly to central frame member 22, such as by welding or brazing.

Alternatively, a U-shaped bracket (not shown) is attached to central frame 22, and the tubular leg section 66 is secured in position between the legs of the U-shaped bracket by two or more bolts extending through the bracket and the tubular section 66. With this arrangement, second leg member 26 can be partially assembled before shipping by inserting one bolt through tubular section 66 and the bracket and pivoting section 66 to a position alongside central frame member 22. To complete assembly of second leg member 26, the consumer need only pivot tubular section 66 into place and insert a second bolt through the U-shaped bracket and section 66.

Figure 3:
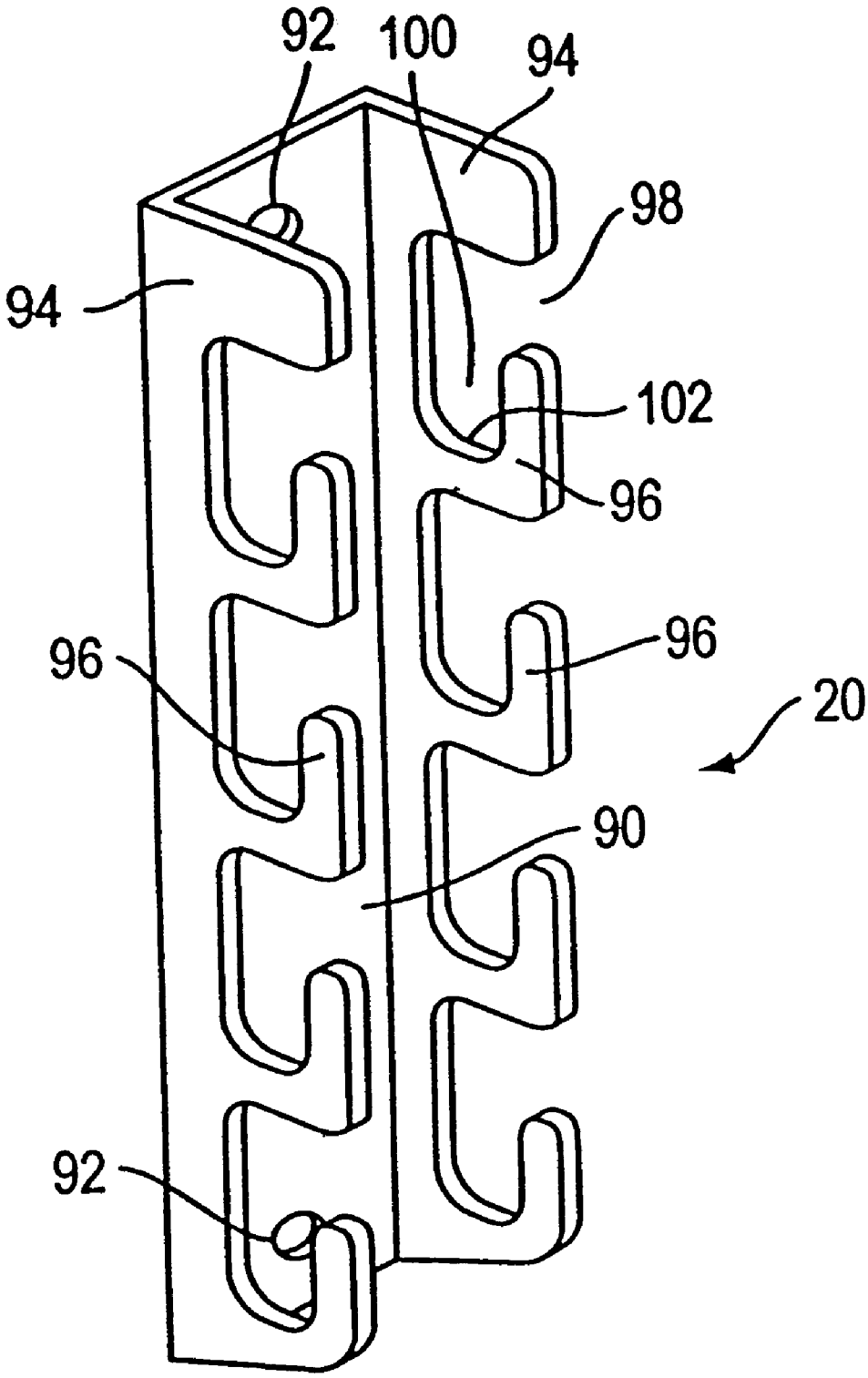
FIG. 3 is a perspective view of a dumbbell storage bracket with J-hook structures axially aligned to provide ease of access for dumbbells while exercising.

As can be seen in FIGS. 4–6, along the back side 85 of the second leg member 26 is a dumbbell rack structure preferably in the form of dumbbell storage bracket 20 bolted longitudinally to leg member 26 by bolts 88. As can best be seen in FIG. 3, a base 90 of the bracket 20 has apertures 92 centrally located at either end of the bracket 20 through which the bolts 88 (see FIG. 4) attach the bracket 20 to the leg member 26. Perpendicular side walls 94 have a multiplicity of hook-shaped structures 96 in parallel arrangement, each having a horizontal slotted entrance portion 98 and a downwardly extending guide portion 100 with an arcuate end 102 for holding dumbbells 101 of various sizes. It can be appreciated that the size and shape of the hook-shaped structures 96 allow the exercise bench 10 to be repositioned without disturbing the placement of the dumbbells 101 on the storage bracket 20.

As shown in FIGS. 4–6, at the top end 40 of the central frame member 22 is the third, pivoting leg member 28 comprising a tubular leg section 104 with a transversely mounted cylindrical foot element 106, of similar size and shape as the foot element 68 on the perpendicularly mounted leg member 26. Foot element 106 preferably includes rubber or plastic end caps 84 placed over the open ends 86. The tubular leg section 104 is welded centrally to the foot element 106 at a bottom end 108 and is pivotally attached to the central frame member 22 at a top end 110 of tubular leg section 104.

The pivotal attachment of leg section 104 comprises a pair of attaching plates 112, preferably having arcuate ends 114, extending perpendicularly from the bottom of the central frame member 22 in spaced, parallel relation. The attaching plates 112 are preferably welded onto the central frame member 22 or may comprise a unitary u-shaped structure that is bolted to the bottom of central frame member 22. A plurality of apertures 118, 119, 120, 121, 122 are formed in plates 112, and a set of apertures are formed into the sides 124 of the tubular leg section 104. The top-most apertures in the tubular leg section 104 are axially aligned with aperture 118 in each of the attaching plates 112, and a pivot pin 126 is passed therethrough and is preferably wedged on the ends, thereby attaching the leg section 104 pivotally to the central frame member 22.

The second apertures formed in tubular leg section 104 are longitudinally spaced from the top-most apertures. As the pivoting leg 28 rotates about the pivot pin 126, the second apertures formed in the leg section 104 will come into axial alignment with the apertures 119, 120, 121, 122 in the attaching plates 112, thereby allowing the pivoting leg member 28 to be secured positionally. More specifically, when the pivoting leg 28 is repositioned, the apertures in tubular leg section 104 of the pivoting leg 28 align with apertures 119, 120, 121, or 122 in the attaching plates 112. A detent-type lock pin 128 of conventional design may be placed through the aligned apertures to thereby secure the leg 28 positionally in place. It can be understood that any means of locking pin device may be used to secure the pivoted leg 28.

The adjustable seat assembly 14 includes a main seat frame member 138, preferably comprising a tubular steel beam of rectangular cross-section, mounted to central frame member 22, via a U-bracket 140, so as to be pivotal with respect thereto about pivot pin 176. Lateral frame members 132, 152, preferably comprising steel strap material, extend across and are attached to main seat frame member 138, preferably by welding.

An arcuate guide member 134 extends from the main seat frame member 138. A plurality of angularly-spaced through holes 178 are formed in the guide member 134. A rectangular through hole 170, which receives the guide member 134, is formed through lower portion 32 of the central frame member 22. A locking pin 136, preferably being of a spring loaded-button release type, extends through an aperture formed in lower portion 32 transversely to rectangular through hole 170. The adjustable seat assembly 14 can be secured in a selected angular orientation by inserting the locking pin 136 through lower portion 32 of central frame member 22 and through a selected one of the through holes 178 formed in the guide member 134.

Alternatively, the seat structure could be rigidly fixed, as by welding, in a preferably perpendicular position with respect to the central frame member 22.

As shown in FIG. 1, the seat rest 16 is attached atop the main seat frame member 138 and lateral frame members 132, 152 and together comprise a seat structure. A rigid backboard (not shown) of suitable material is of a generally rectangular shape, and provides rigidity for the seat rest 16, as well as a means for attaching to the frame members 138, 132, 152. Seat rest 16 is preferably attached to frame members 138, 132, 152 by means of suitable mechanical fasteners, such as screws. A cushion 184 of similar dimensions, and made of a foam-like material, is set atop the backboard. The foam cushion 184 is wrapped in a suitable cover material 186, preferably vinyl, and attached to the underside of the backboard by any conventional means, such as staples.

As can be seen in FIG. 4, a back support structure in the form of the backrest 18 is attached longitudinally along the central frame member 22. A rigid backboard 188 (see FIG. 1) of suitable material is of a generally rectangular shape and provides rigidity for the backrest 18 as well as a means for attaching the backrest 18 to the central frame member 22. A plurality of bolts 190 pass through apertures 192 on the backrest portion 30 of the central frame member 22 and into the backboard 188, fixedly attaching the backrest 18 to the central frame member 22. A foam cushion 194, having a shape similar to that of the backboard 188, is placed atop the backboard 188, and is wrapped by a suitable cover material 186, preferably vinyl. The cover material 186 is then fixed to the underside of the board 188 by any conventional means, such as staples.

As indicated in FIG. 4, there is shown a configuration of the present invention in which the exercise bench 10 is in the inclined position. In this position, the first leg member 24 and the second leg member 26 are set on the floor, with the adjustable seat assembly 14 adjusted to a comfortable sitting position. In this configuration, the backrest 18 is inclined with an upper, or head, end thereof disposed above a lower, or seat, end thereof. While sitting on the seat rest 16, the user will lean back against the backrest 18, thus providing proper support, along with a comfortable exercising position. The pivoting leg member 28 is preferably secured in a retracted position behind the backrest portion 30 of the central frame member 22. The dumbbells 101, conveniently located in the storage bracket 20, are easily removed and replaced by the user while exercising.

FIG. 5 shows the exercise bench 10 in the slant board position. The exercise bench 10 is placed into the slant-board position by rotating the exercise bench 10 about the foot 68 of the second leg member 26, then rotating the third, or pivoting, leg member 28 into a fully extended position with the foot element 106 resting on the floor. The third leg 28 pivots until the aperture in the tubular section 104 is aligned with aperture 122, and pin 128 is inserted to lock leg member 28 into the extended position. The backrest 18 lays in angled relation to the floor with the head end thereof below the seat end thereof, and the seat rest 16 can be pivotally repositioned according the user's discretion.

To hold the feet and legs stationary while performing exercises on a bench configured as a slant board, the user, lying on the user's back, bends his legs up over a thickened leg comfort section at the end of the seat rest 16 and places the top of each foot under each portion of transverse foot element 44 extending on either side of central fame member 22.

FIG. 5 also shows an alternate dumbbell storage rack 200 attached to central frame member 22. Storage rack 200 is similar to rack 20 and includes a plurality (preferably four) hook structures 202 for receiving and holding individual dumbbells. Each hook structure also includes an end lip 204 which prevents dumbbells from rolling out of their respective hook structures when the bench 10 is configured as a slant board.

Although it is preferred that a dumbbell storage rack 20 or 200 be provided and it is especially preferred that the rack 20 or 200 be attached to the bench 10, the dumbbell storage rack may be provided as a separate stand-alone structure or may be omitted altogether.

As shown in FIG. 6, a third position, the flat bench, is also easily configured. To place the exercise bench 10 into the flat bench position from the previous slant-board position, the user simply lifts the backrest portion 30 of the central frame member 22 while rotating and locking the pivoting leg 28 into a substantially perpendicular, transverse position by inserting pin 128 through aperture 120. This puts the backrest 18 into horizontal relation with the floor.

The bench can also be configured in a slanted orientation between the orientation shown in FIGS. 5 and 6 by aligning the aperture in tubular section 104 with aperture 121 and inserting pin 128.

It can be appreciated by those familiar with the art, that the multi-position exercise bench can be used to develop a multiplicity of muscle groups without the need for using a variety of exercise machines. By placing the exercise bench in the inclined, upright position, dumbbell exercises can be used to help strengthen, firm, and tone the muscle groups of the upper body. When converted to the slant-board position, exercises are performed, such as sit-ups, to help strengthen the upper and lower abdominal muscles, as well as the leg muscles. When placed in the flat bench position, dumbbell exercises can be performed to help strengthen the chest and arm muscle groups. As can be understood from the FIGS. 4, 5, and 6, the multi-position exercise bench is uniquely designed to provide a whole body workout.

While the invention has been described in connection with what is presently considered to be the most practical and preferred embodiments, it is to be understood that the invention is not to be limited to the disclosed embodiment, but, on the contrary, it is intended to cover various modifications and equivalent arrangements included within the spirit and scope of the appended claims. Thus, it is to be understood that variations in the particular parameters used in defining the present invention can be made without departing from the novel aspects of this invention as defined in the following claims.

What is claimed is:

1. An exercise bench comprising:

a longitudinal frame structure;

a user support platform carried by said longitudinal frame structure and having a first end and a second end;

a first leg assembly attached to said longitudinal frame structure and extending from said longitudinal frame structure in a generally longitudinal direction;

a second leg assembly attached to said longitudinal frame structure and extending below said user support platform transversely with respect to said first leg assembly, whereby said first leg assembly extends beyond a transverse plane of said second leg assembly; and a third leg assembly attached to said longitudinal frame structure and constructed and arranged to be moveable with respect to said frame structure between a first position extending below said longitudinal frame structure transversely with respect to said first leg assembly and a second position extending from said longitudinal frame structure in a generally longitudinal direction transversely with respect to said second leg assembly, said exercise bench being constructed and arranged to be configured as (1) an incline bench supported by only said first and second leg assemblies on a generally horizontal support surface with said first end of said user support platform disposed above said second end of said user support platform, (2) a flat bench supported by only said second leg assembly and said third leg assembly moved into said first position with said first end of said user support platform at generally the same height above the support surface as said second end thereof, and (3) a slant board supported by only said second leg assembly and said third leg assembly moved into said second position with said second end of said user support platform disposed above said first end of said user support platform, wherein said exercise bench is constructed and arranged to be reconfigured from an incline bench to a flat bench by moving said third leg assembly into said first position and rotating said exercise bench with respect to the support surface about said second leg assembly until said third leg assembly is in contact with the support surface thereby lifting said first leg assembly out of contact with the support surface and to be reconfigured from a flat bench to a slant board by moving said third leg assembly into said second position and rotating said exercise bench with respect to the support surface about said second leg assembly until said third leg assembly is in contact with the support surface.

2. The exercise bench of claim 1 further comprising a seat structure attached to said longitudinal frame structure and constructed and arranged to support a user thereon in a seated position.

3. The multi-position exercise bench of claim 2 further comprising a cylindrical pad structure extending along an end of said seat structure opposite said longitudinal frame structure.

4. The exercise bench of claim 2 further comprising a seat connecting structure for connecting said seat structure to said longitudinal frame structure, said seat connecting structure being fixedly attached to one of said longitudinal frame structure and said seat structure and pivotally attached to the other of said longitudinal frame structure and said seat structure to permit said seat structure to pivot between a first position in which said seat structure is generally perpendicular to said user support platform and a second position in which said seat structure is disposed at an obtuse angle with respect to said user support platform and a locking element constructed and arranged to engage said seat connecting structure to selectively lock said seat structure in one of a plurality of positions from said first position to said second position.

5. The exercise bench of claim 1 further comprising a support structure attached to said longitudinal frame structure for storing a plurality of exercise dumbbells thereon.

6. The exercise bench of claim 1 further comprising a support structure attached to said second leg assembly for storing a plurality of exercise dumbbells thereon.

7. The exercise bench of claim 1 further comprising a foot engaging member attached to said first leg assembly and constructed and arranged with respect to said user support platform to permit a user lying upon said user support platform, while said exercise bench is configured as a slant bench, with the user's feet operatively engaged with said foot engaging member to perform exercises with the user's feet held stationary by said foot engaging member.

8. The exercise bench of claim 1 wherein said third leg assembly is constructed and arranged to be movable into a retracted position whereby said third leg assembly lies in substantially parallel coextensive relation with respect to said frame structure and is selectively securable in said retracted position so as to be unobtrusive when said exercise bench is configured as an incline bench.

9. The exercise bench of claim 1 further comprising a leg mounting structure for mounting said third leg assembly to said frame, said leg mounting structure being fixedly attached to one of said longitudinal frame structure and said third leg assembly and pivotally attached to the other of said longitudinal frame structure and said third leg assembly to permit said third leg assembly to pivot into each of said first position and said second position.

* * * * *